US009738502B2

(12) United States Patent
Brooks et al.

(10) Patent No.: US 9,738,502 B2
(45) Date of Patent: Aug. 22, 2017

(54) ERGONOMIC MANHOLE COVER LIFTING TOOL, SYSTEM, METHOD, AND APPARATUS

(71) Applicant: D.C. Water & Sewer Authority, Washington, DC (US)

(72) Inventors: Wade L. Brooks, Upper Marlboro, MD (US); James Lowell Ramsey Clarke, Washington, DC (US)

(73) Assignee: D.C. Water & Sewer Authority, Washington, DC (US)

( * ) Notice: Subject to any disclaimer, the term of this patent is extended or adjusted under 35 U.S.C. 154(b) by 0 days.

(21) Appl. No.: 15/007,333

(22) Filed: Jan. 27, 2016

(65) Prior Publication Data

US 2016/0214844 A1 Jul. 28, 2016

Related U.S. Application Data

(60) Provisional application No. 62/108,297, filed on Jan. 27, 2015.

(51) Int. Cl.
*B66F 19/00* (2006.01)
*B66F 15/00* (2006.01)

(52) U.S. Cl.
CPC ..... *B66F 19/005* (2013.01); *B66F 15/00* (2013.01)

(58) Field of Classification Search
CPC ..... B66F 19/005; B66F 15/00
USPC ..... 254/129
See application file for complete search history.

(56) References Cited

U.S. PATENT DOCUMENTS 2,655,399 A * 10/1953 McMillan ..... B66F 19/005 254/131
2,921,773 A * 1/1960 Hoelzer ..... B65G 7/12 254/129
3,275,299 A * 9/1966 Meshew ..... B66F 19/005 254/131
3,362,684 A * 1/1968 Davenport ..... B66F 19/005 254/131
3,710,407 A 1/1973 Reid
(Continued)

FOREIGN PATENT DOCUMENTS

FR 2 952 625 A1 5/2011

OTHER PUBLICATIONS

Written Opinion and International Search Report from International Application No. PCT/US2016/014904 dated Aug. 10, 2016.

*Primary Examiner* — George Nguyen
(74) *Attorney, Agent, or Firm* — Blank Rome LLP

(57) ABSTRACT

This disclosure relates to a tool, system of tools, or method of utilizing tools to quickly, safely, ergonomically and effectively lift any number of objects including but not limited to manhole covers and car tires. The user is aided by the tool containing any number of picks that may be directionally adjusted, manually or automatically, latches to connect the tool to attachments (such as tripods, power lifting belts, vehicles, and other tools), additional support handle bars located at or about the center of gravity which may be adjusted from one location to another to guide the body into a lifting posture to reduce back strain and accident potential, pre-molded or moldable sections on the tool or its handlebars to aid the user in gripping the tool, a gyroscope and other features for making the jobs of utility workers and service workers safer, more efficient, and easier.

20 Claims, 5 Drawing Sheets

(56) References Cited

U.S. PATENT DOCUMENTS 3,744,758 A * 7/1973 Nakasone ..... B65G 7/12 254/129
3,837,622 A * 9/1974 Gale ..... B66F 19/005 254/131
3,985,338 A * 10/1976 Herrmann ..... B66F 19/005 254/131
4,365,925 A * 12/1982 Girtz ..... E01F 9/60 254/131
4,488,706 A 12/1984 Kono
4,650,232 A * 3/1987 Perry ..... B66F 19/005 254/131
4,708,320 A * 11/1987 Hodges ..... B25B 25/00 254/129
5,137,314 A * 8/1992 Gunter ..... B66F 19/005 254/131
5,462,385 A * 10/1995 Mohlengraft ..... B66F 19/005 254/131
5,476,300 A 12/1995 Dodge
6,202,985 B1 * 3/2001 Chong ..... B66F 15/00 254/131
6,202,986 B1 * 3/2001 Goldman ..... B66F 19/005 254/131
6,520,482 B1 * 2/2003 Bigham ..... B66F 19/005 254/131
6,676,111 B2 * 1/2004 Bigham ..... B66F 19/005 254/131
6,964,407 B1 * 11/2005 Butler ..... B66F 19/005 254/131
7,275,274 B1 * 10/2007 Radford, Sr. ..... B66F 15/00 254/131
7,699,368 B2 * 4/2010 Nicol ..... A62C 33/00 280/47.3
8,297,596 B2 * 10/2012 Su ..... B66F 15/00 254/129
8,413,959 B2 * 4/2013 Bloswick ..... E02D 11/00 254/120
8,434,739 B1 5/2013 Connolly
8,708,312 B2 * 4/2014 Stawarski ..... B25G 1/06 192/69
9,493,331 B2 * 11/2016 Montgomery ..... B66F 19/005
2005/0242332 A1 * 11/2005 Ueki ..... B66D 1/52 254/277
2007/0158626 A1 * 7/2007 Chang ..... B66F 15/00 254/25
2010/0140575 A1 6/2010 Liou
2010/0251858 A1 10/2010 Huang
2010/0283017 A1 * 11/2010 Darbinyan ..... B66F 15/00 254/129
2010/0286950 A1 * 11/2010 Heijkants ..... A61B 5/1071 702/151
2011/0133140 A1 * 6/2011 Shepherd ..... B62B 1/06 254/131
2012/0102699 A1 * 5/2012 Bruce ..... B25B 27/02 29/275
2013/0328336 A1 * 12/2013 Badger ..... B66F 19/005 294/175
2014/0145127 A1 * 5/2014 Su ..... B25G 1/04 254/129

* cited by examiner

ERGONOMIC MANHOLE COVER LIFTING TOOL, SYSTEM, METHOD, AND APPARATUS

CROSS-REFERENCE TO RELATED APPLICATION

This application claims priority to U.S. Provisional Patent Application No. 62/108,297, filed Jan. 27, 2015. The entire disclosure of U.S. Provisional Patent Application No. 62/108,297 is incorporated herein by reference.

TECHNICAL FIELD

The general field of the disclosure herein relate to methods, systems, or apparatuses involving designing and utilizing manhole cover tools, attaching manhole cover tools to additional equipment and components, or utilizing manhole cover lifting tools in a way that effectively informs the user of how best to quickly use the device while minimizing the risk of strain or injury. The systems, methods, and apparatuses of the disclosure involve a manhole cover lifting tool designed with components the user may utilize to aid in safely removing and restoring manhole covers. The components include but are not limited to a support bar located at a fulcrum that may be adjustable around the center of gravity of the manhole cover lifting tool, a gyroscope attached to the manhole cover lifting tool, a lever hook for attaching the manhole cover lifting tool to a truck or another device, molded hand grips, and a dial for adjusting the angle of the pick located at the base of the manhole cover lifting tool.

BACKGROUND

Many can attest to the back-breaking danger of having to bend over to lift manhole covers, often weighing over one hundred pounds, condensed into lead or concrete discs. While there have been numerous attempts to make it easier to lift manhole covers, a testament to the universal difficulty found in lifting such heavy covers worldwide, few if any such attempts focus specifically on the convenience and portability of cover lifting tools, and as a result few have become popular in public usage. Some such as the Kono patent ('706) focus on having wheels with a base set at a fixed pivot point to act as a lever brace, but this fixed point is not adjustable. Others such as the Dodge patent ('300) have bulkier designs which are not suitable for quick transportation from one manhole to the next, for setup by one individual, a quality which could be quite helpful for crews needing to work in roadways in limited time. Finally, there are disclosures of completely hand-operated picks with similar designs that force the user to insert the manhole cover pick at angles that are difficult to set up, and in some cases could lead to back injury. The main priorities emphasized in such disclosures are speed of setup, ergonomic ease of use, and safety.

According to a 2003 report from the Liberty Mutual Fund Institute for Safety, "opening manhole covers was the biggest cause of accidents in the utility industry." The report describes workers being injured while lifting manhole covers, often causing lower back disorder (LBD) due to overexertion in lifting manhole covers. Others had severe injuries from broken feet and broken or amputated fingers and toes. Previous tool designs intended to address manhole-cover lifting injuries are large and cumbersome, requiring more time and effort to set up and use. The importance of an inexpensive, effective, and easy to use tool that can relieve these types of injuries cannot be overstated. Thus, the present disclosure strives to find one or more practical and creative solutions to addressing problems in the art, and assisting in the lever technology industry overall, including but not limited to manhole picks. While the embodiments disclosed herein may aid users in the water distribution field with lifting manhole covers quickly and safely, it is envisioned that the disclosed embodiments can be used for everything from workers in other utility trades lifting manhole covers to pit crews removing tires in a service lane for NASCAR, INDYCAR, and Formula One races.

SUMMARY

This disclosure concerns a manhole cover lifting tool or a manhole pick for back support and flexibility for use in the field. The embodiments enabled in this disclosure are separate from other prior art in its field because of its emphasis on portability and targeted support at the center of gravity. This disclosure relates to additional handlebars and pivot points for the tool located near the center of gravity, incorporation of position-based technology, such as gyroscopes to allow users to find their "sweet spot" (defined herein as a particular angle for a particular user most effective in lifting covers of a particular size), and additional interfacing ability with related accessories, including but not limited to power lifting belts, designed to reduce the strain on a person's back while lifting heavy items, thereby maintaining balance; tripod assemblies, allowing the pick to first lift the manhole cover from a given point, then from the same tripod set-point restoring the same manhole cover, without the need for re-centering the tripod; and trailer hitch assemblies, where a lever accessory already designed to fit on a standard truck tow hook can interface with the manhole pick for ease of lifting while the truck provides safety for workers removing manhole covers, which are often found in the middle of busy roadways. One of the ergonomic improvements disclosed herein, separating this disclosure from the prior art, involves locating the lifting handle around the center of gravity of the pick. This improvement allows for better mechanical advantage and back support for service workers such as water, sewer, and electrical workers.

DETAILED DESCRIPTION

The present disclosure relates to tools, a system of tools, or a method of utilizing lever tools for lifting objects including but not limited to manhole covers and vehicle tires. This application describes a variety of ways to build, adjust, and set up lever tools to quickly and efficiently utilize mechanical advantage.

In this disclosure the term "shaft" refers to a rod of any length, but much longer than it is wide, which shaft may be flat, cylindrical, or polygonal-shaped. The term "pick" refers to a connecting section of rod which may have a variety of shapes, including but not limited to flat, curved, hooked, or cylindrical, but should be angled in a direction different from that of the shaft to be envisioned as part of the tool. The term "mechanical dial" refers to an angle adjustment mechanism which may be attached to the pick and/or the shaft and adjusted by a variety of suitable methods including but not limited to being turned by hand by the user, being turned remotely by a digital indicator which responds to the user's inputs and sends a signal to the mechanical dial to automatically adjust the angle of the pick from the shaft, or an automated adjustment set to be triggered by a timer that can be set before placing the pick into a manhole cover hole. These embodiments are envisioned to allow the user to gain a mechanical advantage from the pick, which may be adjustable, while utilizing any additional handle bar(s) for balance or the assistance of a second hand and/or additional user(s).

In this disclosure the term "lever" refers to a shaft connected to a pick, which is to be used to lift an object located at the pick end, while the lever is attached to something at another location. This disclosure also relates to a method of utilizing a system of levers and apparatuses to attach a lever to a vehicle, tripod, additional tool, power lifting belt, or other object, adjusting a secondary or any other suitable number of bars located on the lever into position at or around the new center of gravity of the lever, locking the bar(s) into place, and lifting the lever (and the object it is attached to at the pick end).

Figure 1:
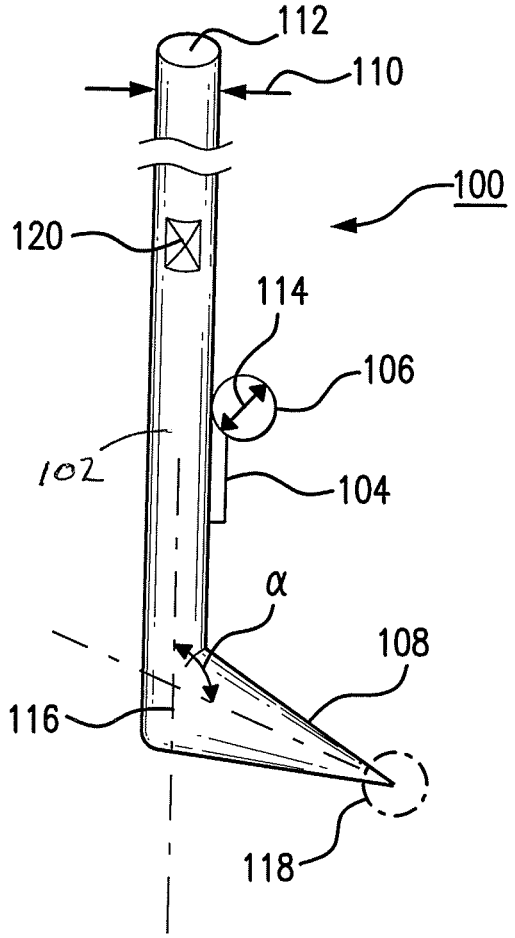
FIG. 1 shows a manhole cover removal tool with a lifting aid located at or about the center of gravity of the device.

Referring now to the drawings, where like reference numerals designate like elements, there is shown in FIG. 1 a tool 100 that has a shaft 102 that is connected to a lifting guide 104. A handle bar 106 is located at or around the center of gravity of the tool 100. The tool 100 also has a pick 108. The term "lifting guide" refers to an extension that juts from a face of the shaft 102. The illustrated lifting guide 104 may be used for a variety of purposes, including but not limited to the user approximating the distance from a location of the rod 102 to the pick 108. The handle bar 106, which may be attached to the lifting guide 104, may be used to increase the effective lifting torque of the tool 100. According to one aspect of this disclosure, the position of the handle bar 106 may be adjustable along the length of the rod 102, and the tool 100 may be configured to fix and lock the handle bar 106 into place at a desired location. According to another aspect of this disclosure, more than one handle bar may be attached to the shaft 102.

According to preferred embodiments of this disclosure, the shaft 102 may be a cylindrical bar of steel, or other suitable material, with a diameter 110 less than about two inches. The distance from a distal end 112 of the shaft 102 to the handle bar 106 may be in the range of from about one foot to about three feet. An exterior diameter 114 of the handle bar 106 may be in the range of from about one inch to about four inches. The length of the shaft 102 from the distal end 112 to a proximal end 116 where the shaft 102 is connected to the pick 108 is preferably at least four feet. If desired, the pick 108 may be formed by heating the shaft 102 white hot and bending the pick 108 to the illustrated angle $\alpha$ and providing an end point 118. In operation, the end point 108 is inserted into an opening in a manhole cover (not illustrated in FIG. 1). The tool 100 may have dimensions other than those described herein. However, in preferred embodiments of this disclosure, the width of the tip 118 of the tool 100 should be in the range of from about 0.50 inch to about 0.625 inch to fit into a conventional manhole opening.

According to another aspect of this disclosure, the length of the shaft 102 is extendable by concentric sections, attaching sections, and/or other suitable devices. In other embodiments of this disclosure, the location of the lifting guide 104 and/or the handle bar 106 may be adjustable to account for a change in the center of gravity of the tool 100 if the shaft length is extended or if the tool 100 is attached to another object. In other embodiments of this disclosure, the shaft length is extendable. In still other embodiments of this disclosure, the shaft may be fitted with a gyroscope 120 which is used to give the user (not illustrated in FIG. 1) some indication of the angle at which the shaft 102 is aligned relative to vertical. The gyroscope 102 may either be external, so that the user can look at it directly, or internal and configured to relay the angle from vertical to the user via an electronic system, including but not limited to sending a signal to a display (not illustrated) which indicates the angle, or sending a signal to a speaker (not illustrated) which verbally indicates the angle. One advantage of the gyroscope 120 is that it can aid users of varying heights and arm lengths in knowing what angle gives them the best mechanical advantage for lifting objects of different weights, also known as determining their "sweet spot."

Figure 2:
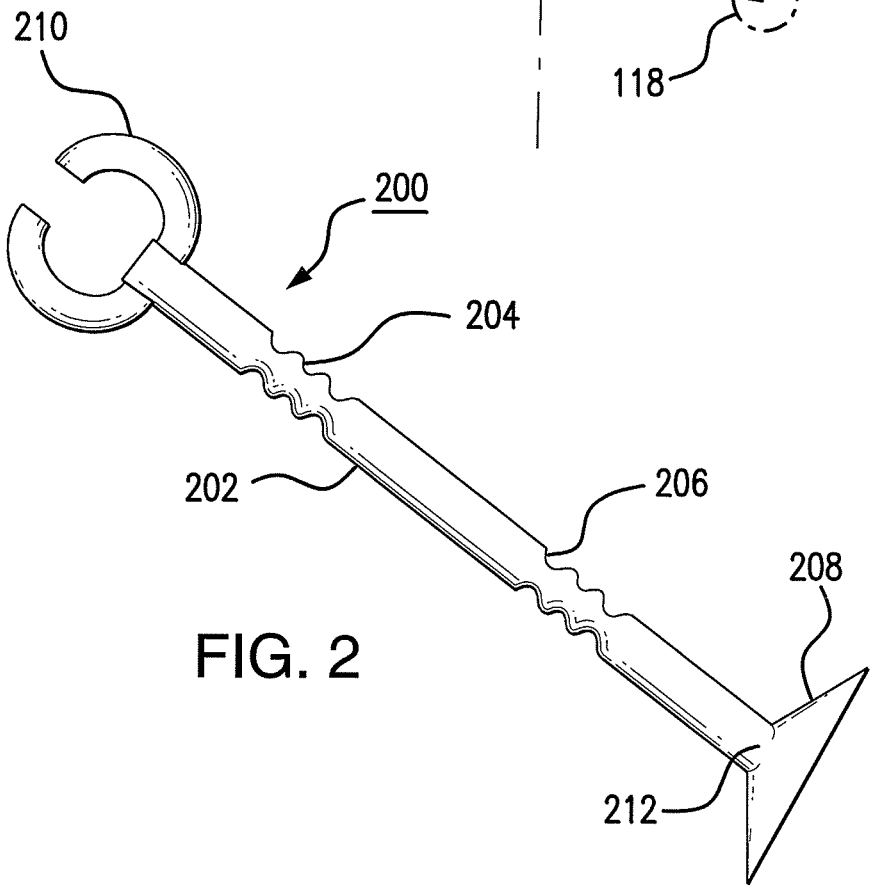
FIG. 2 shows a manhole cover removal tool with lever hooks for attachment, and including molded sections.

According to another aspect of this disclosure, referring now to FIG. 2, a tool 200 has a shaft 202 (which may be cylindrical). The shaft 202 is connected to molded sections 204, 206 located around the center of gravity of the tool 200, and a pick 208 may be located at a proximal end 212 of the shaft 202. The tool 200 may include an attachment hook 210 as might be needed for a system of attaching a lever to another object. The molded sections 204, 206 are areas where the user may ergonomically grab the tool 200. The molded sections 204, 206 may be composed of a variety of materials including but not limited to rubber, Velcro, or foam.

Figure 3:
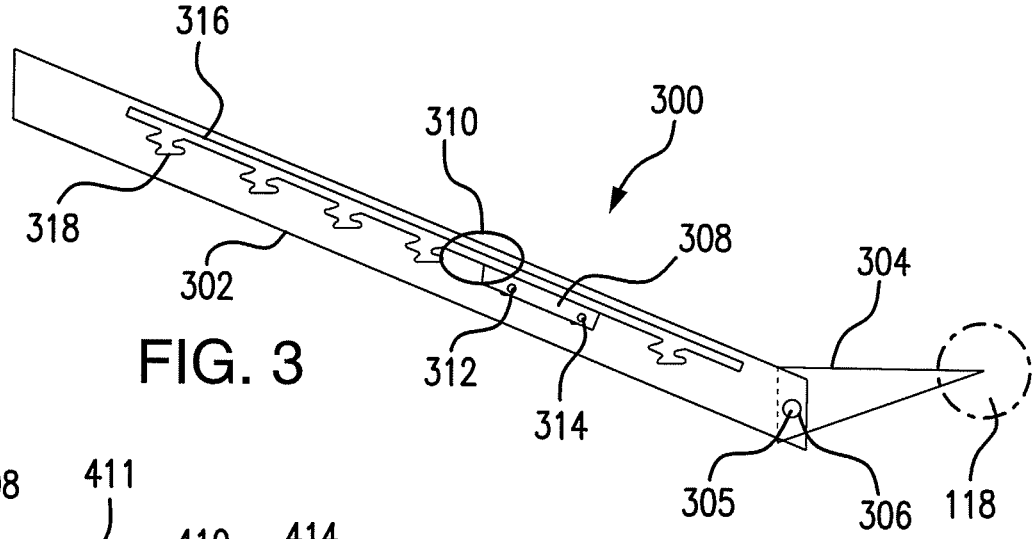
FIG. 3 shows a manhole cover removal tool with a removable pick (fastened by a pin for alternating pick ends better suited for use on different orifices), and a lifting guide with pins for changing its position along a grooved track on the shaft.

Another embodiment of this disclosure, referring now to FIG. 3, includes a shaft 302 connected to a pick 304, which may be released from the shaft 302 by removing a pin 305 from a hole 306 in both the shaft 302 and the pick 304. The illustrated tool 300 may include a lifting guide 308 with a handle 310 which is removable by removing pins 312, 314, and which can also be used to adjust the position of the lifting guide 308 as the pins 312, 314 slide along a track 316, imbedded within or attached to the shaft 302. The tool 300 may further include ridges 318 or latches within the track 316 to hold the lifting guide 308 stationary in a fixed position.

Figure 4:
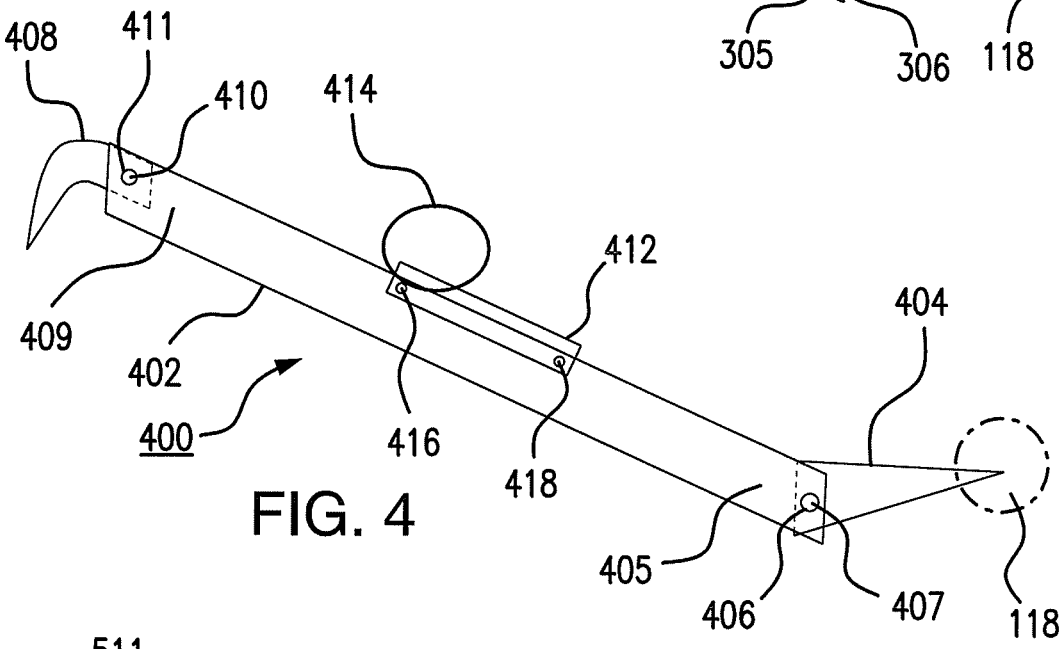
FIG. 4 shows a manhole cover remover with two styles of removable picks on either end and a removable lifting guide on one side of the shaft around the center of gravity.

A tool 400 constructed in accordance with another embodiment of this disclosure is illustrated in FIG. 4. The tool 400 has a shaft 402 that is connected to a pick 404, which may be released from the distal end 405 of the shaft 402 by removing a pin 407 from a hole 406 that extends through both the shaft 402 and the pick 404. If desired, an additional pick 408 may be fastened to the other end 409 of the shaft 402 by securing a lock or a pin 411 through a hole 410. In operation, the pin 411 extends through both the shaft 402 and the second pick 408. This embodiment may include a removable lifting guide 412, which may include a handle bar 414. The lifting guide 412 may be fastened to the shaft 402 by removable pins 416, 418. As illustrated in FIG. 4, the first pick 404 may have a non-hooked configuration and the second pick 408 may have a hooked configuration. In operation, the selection of which of the two different picks 404, 408 is to be inserted into a manhole cover opening is advantageously determined by the user, according to different situations encountered at various job sites.

Figure 5:
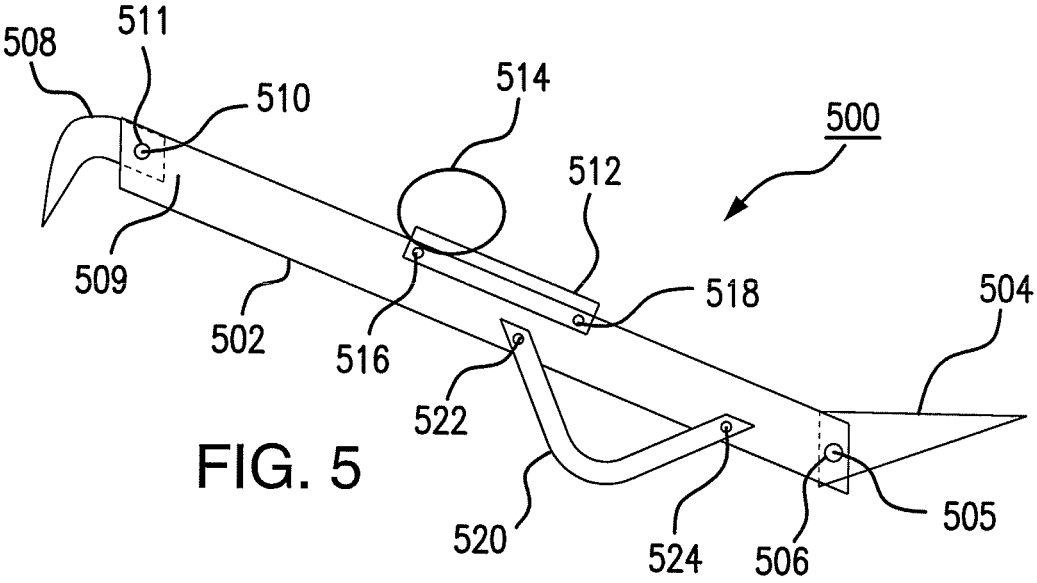
FIG. 5 shows a manhole cover remover with two styles of removable picks on either end and two styles of removable picks on either side of the shaft.

Referring now to FIG. 5, another embodiment of this disclosure includes a shaft 502 connected to a pick 504, which may be released by removing a pin 505 from a hole 506. According to a preferred embodiment, the hole 506 extends through both the shaft 502 and the pick 504. An additional pick 508 may be fastened to another end 509 of the shaft 502. The second pick 508 may be secured to the shaft 502 by a lock or a pin 511 extending through a hole 510. The tool 500 illustrated in FIG. 5 may include a removable lifting guide 512, which may include a handle bar 514, and which may be fastened to the shaft 502 by removable pins 516, 518. If desired, the tool 500 may further include another lifting guide 520 which may be removable by releasing pins 522, 524.

Figure 6:
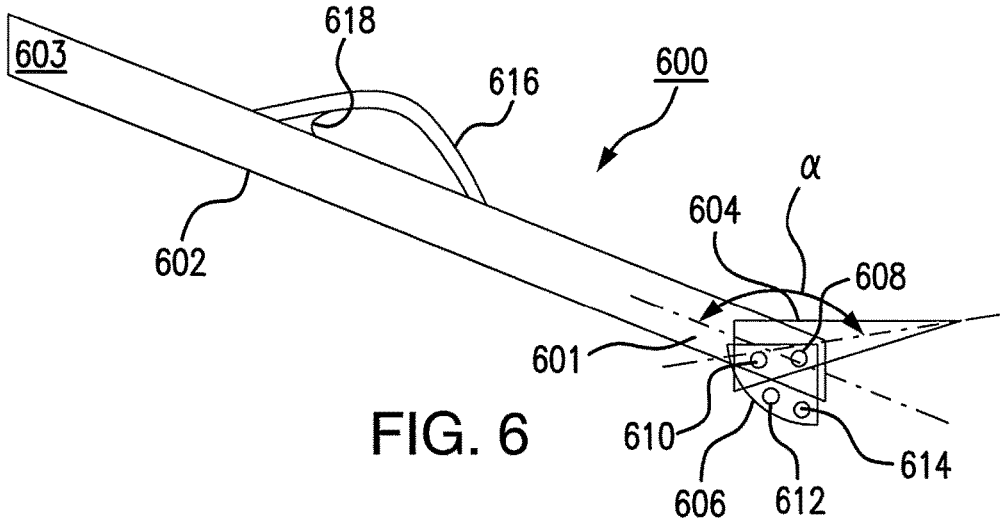
FIG. 6 shows a modified manhole cover remover with an adjustable and removable pick (which may be repositioned by removing an interior pin and reinserting at a rotated position in a dial), a lifting guide, and a trigger within the lifting guide for lifting the interior pin to adjust the angle of the pick.

Referring now to FIG. 6, a manhole cover removal (handling) tool 600 has a shaft 602 with distal and proximal ends 603, 601. A non-hooked pick 604 and a dial 606 are located at the proximal end 601 of the shaft 602. The dial 606, the pick 604, and the shaft 602 may be fastened together by one or more suitable devices, including but not limited to a pin, lock, or latch driven through a hole 608 in the shaft pick 604 and dial 606. The angle $\alpha$ of the pick 604 relative to the axis of the rod-shaped shaft 602 may be adjusted by securing or removing another such fastener through a plurality of secondary holes 610, 612, 614. For ease of angular adjustment, the fastener may be released by a user who is holding the shaft 602 and its lifting guide 616, pulling a trigger 618 within the lifting guide 616 that is connected to a release on the second fastener, before a spring forces it back into a new hole. The trigger 618 may be connected to the release mechanism by a cable (not illustrated) or some other suitable mechanism.

Figure 7:
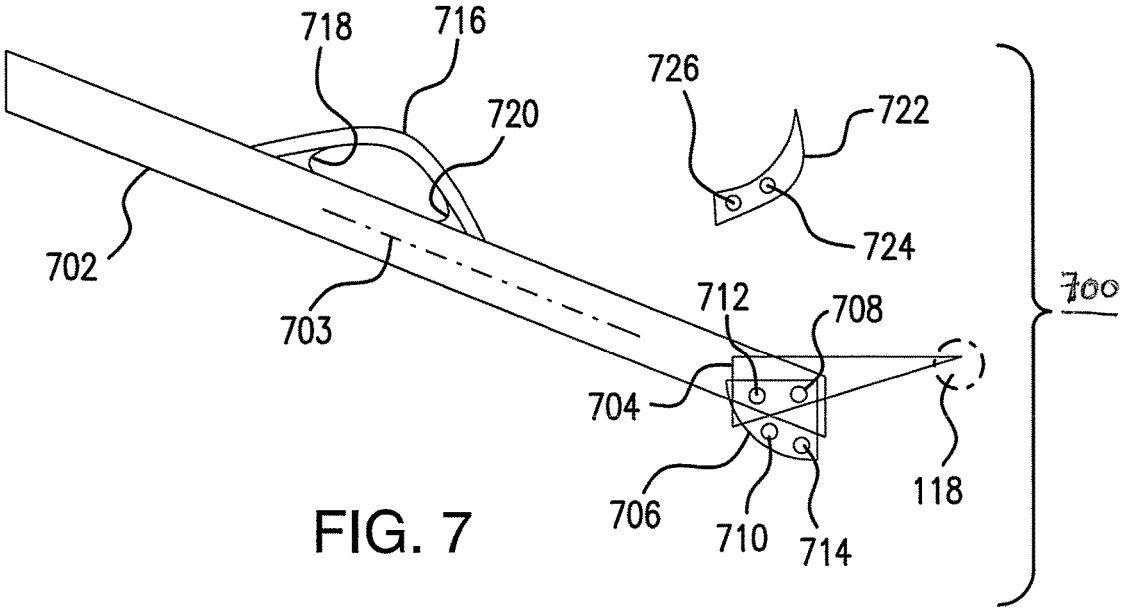
FIG. 7 shows a modified manhole cover remover with an adjustable and removable pick, a lifting guide, dual triggers within the lifting guide (one for lifting the adjustment pin and the other for lifting the removal pin), a dial with holes for adjusting the pick angle, and an alternate pick to swap with the existing one when it is released by the user.
Figure 8:
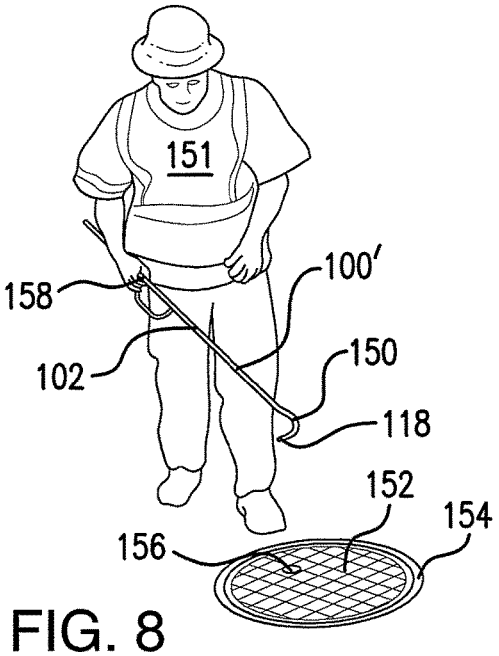
FIGS. 8-11 illustrate a method of removing a manhole cover from a manhole according to one embodiment, with a hooked pick.

Another tool 700 is illustrated in FIG. 7. The tool 700 has a shaft 702 that is connected to a pick 704 and a dial 706. The dial 706, the pick 704, and the shaft 702 may be fastened together by one or more suitable devices including but not limited to a pin, lock, or latch driven through a hole 708 in the shaft 702, the pick 704, and the dial 706. The angle of the pick (the angle $\alpha$ between the direction in which the pick end 118 points and the axis 703 of the shaft 702) may be adjusted by securing or removing a fastener through secondary holes 710, 712, 714. For ease of adjustment of the angle $\alpha$, the fastener may be released by a user who is holding the shaft 702 and the lifting guide 716, pulling a trigger 718 within the lifting guide 716 that is connected to a release on the second fastener, before a spring forces it back into a new hole. The fastener or fasteners securing the pick 704 to the dial 706 and the shaft 702 may be released by pulling another trigger 720 connected to the fastener(s) such that another style of pick 722 (for example the illustrated hooked pick 722) may be inserted with holes for fastening 724 and angle adjustment 726.

Figure 9:
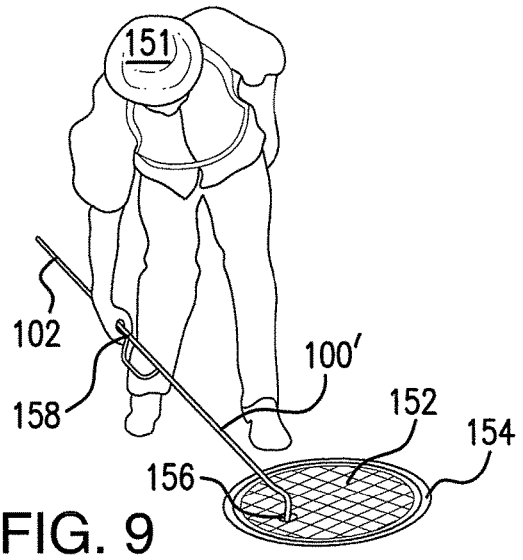
Figure 10:
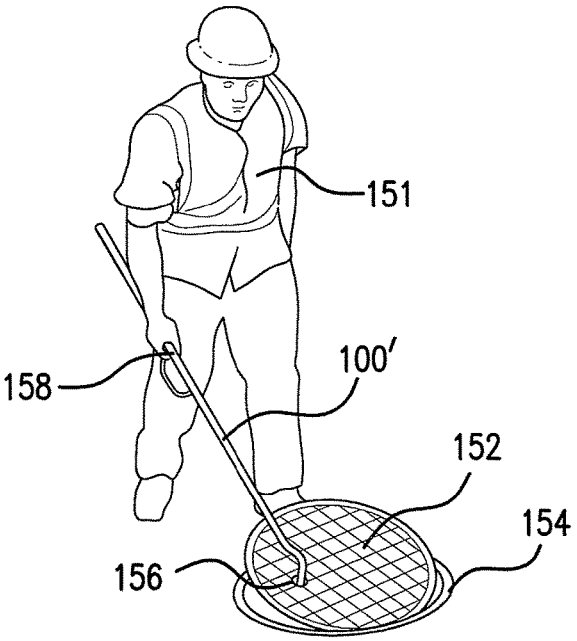
Figure 11:
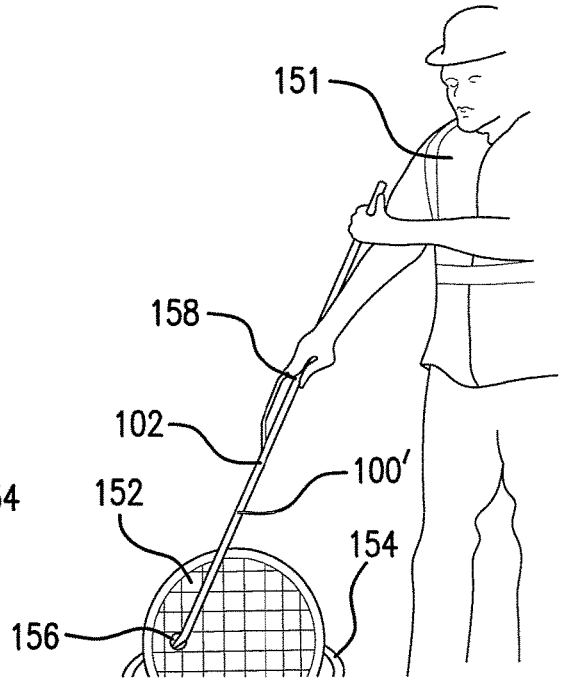

In operation, as shown in FIGS. 8-11, a tool 100' with an integrally-formed hooked pick 150 may be used to remove a manhole cover 152 from a manhole 154. The end 118 of the pick 150 is inserted into an opening 156 in the cover 152 as shown in FIG. 9. Then, the shaft 102 is lifted by the user 151 from a point 158 near the center of gravity of the tool 100', to remove the cover 152 from the manhole 154, as illustrated in sequence from FIG. 10 to FIG. 11.

Figure 12:
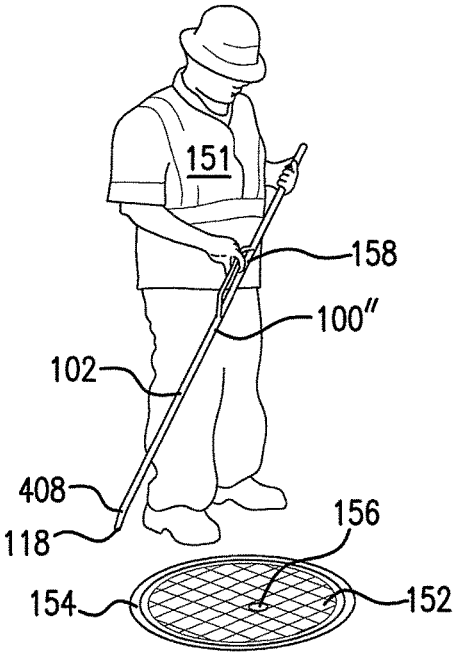
FIGS. 12-14 illustrate a method of removing the manhole cover of FIGS. 8-11 from the manhole according to another embodiment, with a non-hooked pick.
Figure 13:
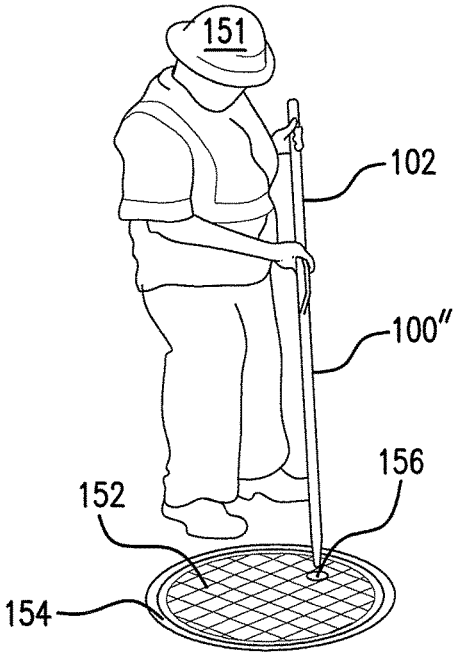
Figure 14:
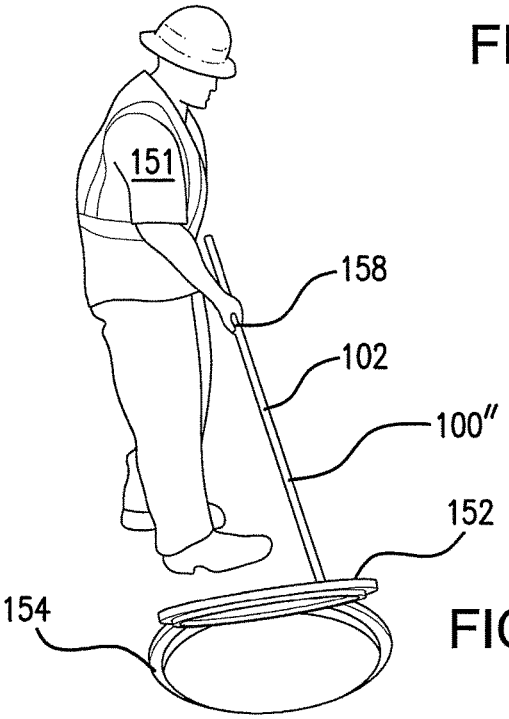

According to another exemplary method of operation, as shown in FIGS. 12-14, a tool 100" may have an integrally-formed non-hooked pick 408. The end 118 of the pick 408 is inserted into the opening 156 in the cover 152 as shown in FIG. 13. Then, the shaft 102 is rotated downward, without lifting, from a point 158 near the center of gravity of the tool 100", to remove the cover 152 from the manhole 154, as illustrated in FIG. 14. The cover 152 is rotated out of the manhole 154 by first pushing downward on the tool 100" and then pulling the tool 100" in a direction away from the manhole 154.

It is understood that the various preferred embodiments are shown and described above to illustrate different possible features of the disclosure and the varying ways in which these features may be combined. Apart from combining the features of the above embodiments in varying ways, other modifications are also considered to be within the scope of the disclosure. The disclosure is not intended to be limited to the preferred embodiments described above, but rather is intended to be limited only by the claims set out below. Thus, the disclosure encompasses all alternate embodiments that fall literally or equivalently within the scope of these claims.

The invention claimed is:

1. A method of handling a heavy object, wherein the heavy object is a manhole cover having an opening, said method comprising the steps of:

providing an elongated tool including a solid rod and a hook-shaped pick, wherein the solid rod has a length no shorter than two feet, wherein the solid rod has a distal end and a proximal end, wherein the hook-shaped pick has an attachment end and an insertion end, wherein the attachment end of the hook-shaped pick is integrally attached to the proximal end of the solid rod;

moving the elongated tool toward a manhole, while the manhole is covered by the manhole cover, until the insertion end of the hook-shaped pick is located directly over the opening of the manhole cover and beneath the proximal end of the solid rod;

subsequently, while a radius of curvature of the hook-shaped pick is directed generally downwardly, moving the insertion end of the hook-shaped pick downwardly and thereby causing the insertion end of the pick to be inserted into the opening of the manhole cover;

subsequently, while the insertion end of the pick is located within the opening of the manhole cover, pulling upwardly on the solid rod of the elongated tool and thereby lifting a portion of the manhole cover from the manhole while another portion of the manhole cover remains in contact with the manhole.

2. A lifting tool, comprising:

an elongated shaft having a lifting guide with a handle located at or about a center of gravity, and a pick, and wherein the lifting tool further comprises extendable sections, and wherein the position of the lifting guide or the handle is adjustable, and wherein the tool is configured to lock the lifting guide or the handle into position at a plurality of locations along the length of said shaft.

3. The tool of claim 2, further comprising retractable pins for securing a lifting guide or a handle into one or more positions.

4. The tool of claim 2, further comprising a section of connected tracks with latches for securing a lifting guide in one or more positions at a point furthest from a header track on a plurality of branch tracks.

5. The tool of claim 2, wherein the pick is no longer than ten inches, wherein the rod and the pick meet at a curved pick angle of from about ten to about one hundred and seventy degrees.

6. The tool of claim 5, wherein the curved pick angle is adjustable by a user within a range of from about ten to about one hundred and seventy degrees, and wherein the curved pick angle may be fixed.

7. The tool of claim 5, wherein the curved pick angle is adjustable such that a user can set the curved pick angle to a desired angle amount, and then fix the curved pick angle by adjusting a mechanical dial.

8. The tool of claim 2, further comprising molded sections.

9. The tool of claim 2, wherein a hole extends through both said shaft and said pick, and wherein said tool further comprises a removable pin configured to be inserted in said hole to secure the shaft to said pick.

10. The tool of claim 2, wherein the shaft has first and second ends opposite from each other, and wherein said pick is located at said first end of the shaft, and wherein the tool includes a second pick, and wherein the second pick is located at the second end of the shaft.

11. The tool of claim 2, further comprising a lifting guide, removable pins, and holes for receiving the pins, for securing the lifting guide to the shaft.

12. The tool of claim 9, further comprising holes at ends of the shaft, and pins for cooperating with the holes to secure removable picks to said shaft.

13. A lifting tool, comprising:

an elongated shaft having a lifting guide with a handle located at or about a center of gravity, and a pick, and wherein a hole extends through both said shaft and said pick, wherein said tool further comprises a removable pin configured to be inserted in said hole to secure the shaft to said pick, and wherein said lifting tool further comprises a dial with holes corresponding to a second hole on said pick for allowing the pick to pivot with the removal of a second pin and be secured at a new angle along the dial with said second pin fastening into the rotated pick at a different hole.

14. The tool of claim 13, wherein said tool is configured such that, when said second pin is pulled from a hole, said second pin rotates as the pick is rotated and said second pin is received in a new hole along the dial.

15. The tool of claim 14, further comprising a trigger, connected to said second pin by a lever or pulley for raising said second pin from a hole when the trigger is pulled.

16. The tool of claim 14, wherein said tool is configured such that, when said pin is pulled from a hole in the shaft, said pick can be manually removed and replaced by another pick.

17. The tool of claim 16, further comprising a trigger connected to said pin by a lever or pulley for raising said pin from a hole when the trigger is pulled.

18. A lifting tool, comprising:

an elongated shaft having a lifting guide with a handle located at or about a center of gravity, and a pick, and wherein said lifting tool further comprises a gyroscope.

19. The tool of claim 18, wherein said gyroscope relays a signal to a processor which translates and relays an angle measured by the gyroscope on a display.

20. The tool of claim 18, wherein said handle is a circular loop connected in one or more positions along said shaft.

* * * * *